United States Patent [19]

Baldridge et al.

[11] Patent Number: 4,624,316

[45] Date of Patent: Nov. 25, 1986

[54] SUPER SEAL VALVE WITH MECHANICALLY RETAINED SEAL

[75] Inventors: Morris G. Baldridge; Bob L. Sullaway, both of Duncan, Okla.

[73] Assignee: Halliburton Company, Duncan, Okla.

[21] Appl. No.: 655,979

[22] Filed: Sep. 28, 1984

[51] Int. Cl.[4] ..... E21B 34/08; E16K 15/00

[52] U.S. Cl. ..... 166/325; 166/285; 137/515

[58] Field of Search ..... 166/285, 325, 326; 137/515, 512.3, 859, 624.13

[56] References Cited

U.S. PATENT DOCUMENTS

| | | | |
|---|---|---|---|
| 2,771,091 | 11/1956 | Baker et al. | 137/515 X |
| 2,802,482 | 8/1957 | Arnhold | 137/515 X |
| 3,385,370 | 5/1968 | Knox et al. | 166/285 X |
| 3,776,250 | 12/1973 | Knox | 137/71 |
| 3,957,114 | 5/1976 | Streich | 166/285 |
| 4,067,358 | 1/1978 | Streich | 137/515 X |
| 4,338,999 | 7/1982 | Carter, Jr. | 166/117 |

OTHER PUBLICATIONS

Halliburton Sales and Service Catalog, 1960, p. 53.

Halliburton Services Sales and Service Catalog, No. 41, p. 3846.

*Primary Examiner*—Stephen J. Novosad

*Assistant Examiner*—David J. Bagnell

*Attorney, Agent, or Firm*—James R. Duzan

[57] ABSTRACT

A valve seal assembly for use in well cementing equipment in well cementing operations and the like having an elastomeric seal positively, mechanically retained on the valve body head so that movement of the elastomeric seal on the valve body stem and with respect to the valve body head is prevented.

5 Claims, 1 Drawing Figure

SUPER SEAL VALVE WITH MECHANICALLY RETAINED SEAL

BACKGROUND OF THE INVENTION

This invention relates to an improved valve assembly for use in well tools; more specifically, well cementing equipment or the like.

In some prior art types of valve assemblies used in well cementing equipment a poppet type valve is used where the valve body head contains an annular recess therein retaining, in turn, a portion of an elastomeric seal therein which sealingly engages the valve body housing. A typical example of this type prior art valve assembly is shown on page 53 of the 1960 Halliburton Sales and Service Catalog.

Another type of prior art valve assembly used in well cementing equipment has a poppet type valve used therein where the valve body head contains an elastomeric seal adhesively retained thereon to sealingly engage the valve body housing. A typical example of this type prior art valve assembly is shown on page 3846 of Halliburton Services Sales and Service Catalog Number 41 and is illustrated in U.S. Pat. Nos. 3,776,250; 3,957,114; and 4,338,999.

However, these prior art valve assemblies have limitations in use. For instance, where the elastomeric seal is retained in an annular recess on the valve body head of the poppet type valve, high velocity well fluids washing over the valve body head tend to wash the elastomeric seal from the annular recess. In other instances, where the valve body head contains an elastomeric seal adhesively retained thereon, in deep, hot wells where oil based muds are used, the adhesive loses strength thereby allowing the elastomeric seal to wash off the valve body head.

STATEMENT OF THE INVENTION

In contrast to the prior art valve assemblies, the present invention is directed to an improved valve assembly used in well tools; more specifically, well cementing equipment or the like having an elastomeric seal positively, mechanically retained on the valve body head.

The advantages of the present invention will be readily apparent from the following detailed description of the invention when taken in conjunction with the accompanying drawing.

DETAILED DESCRIPTION OF THE INVENTION

Figure 1:
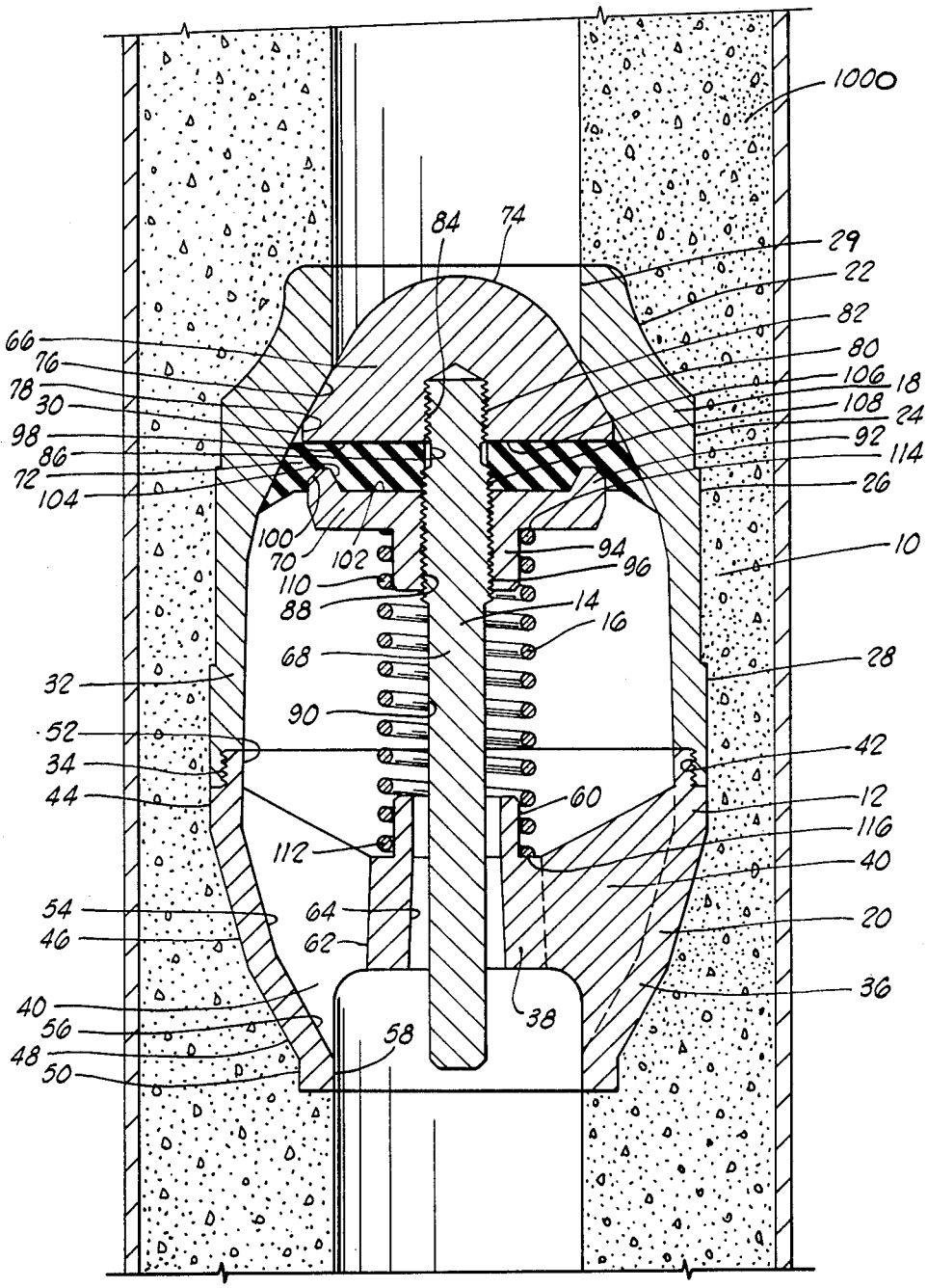
FIG. 1 is a cross-sectional view of the present invention.

Referring to FIG. 1, the preferred embodiment of the valve assembly 10 of the present invention is shown as a well cementing tool 1000 or the like.

The valve assembly 10 of the present invention comprises a valve body housing 12, valve body 14, and valve spring 16.

The valve body housing 12 comprises valve seat portion 18 and valve spring retainer portion 20 and is retained within the well cementing tool 100 or the like by material 102, such as a cementitious material.

The valve seat portion 18 comprises an annular cylindrical member having, on the exterior thereof, arcuate cylindrical surface 22, first cylindrical surface 24, second cylindrical surface 26, and third cylindrical surface 28 and, on the interior thereof, first cylindrical bore 29, arcuate, frusto-conical sealing bore 30, second cylindrical bore 32 and threaded bore 34.

The valve spring retainer portion 20 comprises an annular outer cylindrical member 36 having a valve body guide 38 retained therein by means of a plurality of supports or struts 40 extending from the outer cylindrical member 36 to the valve body guide 38.

The annular outer cylindrical member 36 comprises an annular cylindrical member having, on the exterior thereof, threaded surface 42 which threadedly, releasably engages threaded bore 34 of valve seat portion 18, first cylindrical surface 44, first frusto-conical surface 46, second frusto-conical surface 48 and second cylindrical surface 50 and, on the interior thereof, first cylindrical bore 52, first frusto-conical bore 54, second frusto-conical bore 56, and second cylindrical bore 58.

The valve body guide 38 comprises an annular cylindrical member having, on the exterior thereof, first cylindrical surface 60 and second cylindrical surface 62 and, on the interior thereof, bore 64.

The valve body housing 12 may be constructed of any suitable material depending upon the environment in which it is to be used, such as aluminum or phenolic plastic, etc.

The valve body 14 comprises a valve body head 66, valve body stem 68, valve seal retainer 70 and elastomeric valve seal 72.

The valve body head 66 comprises a cylindrical member having a spherical upper end 74, frusto-conical outer surface 76 which engages arcuate, frusto-conical sealing bore 30 of valve seat portion 18 of valve body housing 12, cylindrical surface 78 and end surface 80 having blind threaded bore 82 therein.

The valve body stem 68 comprises an elongated cylindrical member having first threaded surface 84 which releasably, threadedly engages blind threaded bore 82 in valve body head 66, first cylindrical surface 86, second threaded surface 88 and second cylindrical surface 90 which is slidably received and retained within bore 64 of valve body guide 38 of valve spring retainer portion 20 of valve body housing 12.

If desired, the valve body stem 68 may contain a single threaded surface which would replace a first threaded surface 84 and second threaded surface 88.

The valve seal retainer 70 comprises a cylindrical member having an annular rib 92 on one end thereof, spring retainer portion 94 on the other end thereof, and threaded bore 96 therethrough which releasably, threadedly engages second threaded surface 88 of valve body stem 68 of valve body 14 to retain the elastomeric valve seal 72 on the valve body stem 68 abutting end surface 80 of valve body head 66.

The elastomeric valve seal 72 comprises a circular elastomeric member having upper end surface 98, frusto-conical sealing surface 100 which sealingly engages arcuate, frusto-conical sealing bore 30 of valve seat portion 18 of valve body housing 12, bottom end surface 102 having annular recess 104 therein which receives annular rib 92 of valve seal retainer 70 therein, first bore 106 which receives first cylindrical portion 86 therein and first threaded portion 84 therethrough of valve body stem 68 and second bore 108 which receives a portion of second threaded portion 88 of valve body stem 68 therein. When the elastomeric valve seal 72 is in an assembled relationship with valve body head 66, valve body stem 68, and valve seal retainer 70, the seal 72 is mechanically retained on the stem 68 between the head 66 and retainer 70 by the retainer threadedly engaging stem 68 and stem 68 passing through bores 106 and 108 of retainer 70 while the stem threadedly engages head 66.

The valve spring 16 comprises a resilient annular spring member having one end 110 overlaying spring retainer portion 94 of valve seal retainer 70 abutting a portion of surface 114 thereof while the other end thereof overlays first cylindrical surface 60 abutting annular surface 116 of valve body guide 38 thereby resiliently biasing valve body head 66 and elastomeric valve seal 72 into engagement with arcuate, frusto-conical sealing bore 30 of valve seat portion 18 of valve body housing 12 when the valve assembly 10 is assembled.

Preferably, when the valve seal retainer 70 is threadedly secured to the second threaded surface 88 of the valve body stem 68, a thread locking compound is used to secure the retainer 70 on the stem 68 to prevent removal therefrom. A suitable thread locking compound is known and sold under the trademark name of Halliburton Weld-A.

The valve body head 66 may be made of any suitable material such as aluminum, phenolic plastic, etc.

The elastomeric valve seal 72 may be made of any suitable elastomeric material depending upon the conditions of use to which it is subjected.

The valve stem 68 and valve seal retainer 70 may be made of any suitable metal.

While the valve seat portion 18 and spring retainer portion 20 have been shown as releasably threadedly retained, if desired, they may be retained by any suitable method of attachment depending upon the type of material from which they are constructed and the conditions of use to which they are to be subjected.

It will be understood by those skilled in the art that the valve assembly 10 of the present invention offers advantages and improvements over the prior art valve assemblies used in well cementing equipment by mechanically retaining the elastomeric valve seal 72 on the valve body 14 to prevent the loss therefrom during well cementing operations.

It will be further understood by those skilled in the art that changes or modifications may be made to the present invention so long as such changes or modifications do not constitute departures from the spirit and scope of the invention which changes or modifications are intended to be within the scope of the claimed invention.

Having thus described our invention, we claim:

1. An improved valve assembly used in a well cementing tool in a well cementing operation or the like, said valve assembly comprising:

an annular valve body housing retained within said cementing tool or the like, the annular valve body housing comprising:

a valve seat portion having a bore therethrough; and a valve spring retainer portion secured to the valve seat portion and having a bore therethrough, the valve spring retainer portion comprising:

an annular outer cylindrical member having a valve body guide retained therein by means of a plurality of supports extending from the outer cylindrical member to the valve body guide; and a valve body retained within the valve body housing, the valve body including;

a valve body head adapted to engage a portion of the interior of the valve body housing, the valve body head comprising:

a cylindrical member having a spherical end, frusto-conical outer surface and end surface having, in turn, a blind threaded bore therein;

a valve body stem having one end secured to the valve body head, the valve body stem comprising:

an elongated cylindrical member having a first threaded surface which releasably threadedly engages the blind threaded bore in the end surface of the valve body head, a first cylindrical surface, a second threaded surface which is slidably received and retained within the valve spring retainer portion of the annular valve body housing;

an elastomeric valve seal retained on the valve body stem in constant, uninterrupted, abutting relationship with the valve body head and adapted to sealingly engage a portion of the interior of the valve body housing, the elastomeric valve seal comprising:

a circular elastomeric member having an upper end surface, a frusto-conical sealing surface, a bottom end surface having, in turn, an annular recess therein, a first bore which receives the first cylindrical surface of the valve body stem therein, and a second bore which receives a portion of the second threaded surface of the valve body stem therein;

a valve seal retainer secured to the valve body stem having a portion thereof abutting the elastomeric valve seal constantly to prevent movement of the elastomeric valve seal on the valve body stem and with respect to the valve body head, the valve seal retainer comprising:

a cylindrical member having an annular rib on one end thereof engaging the annular recess in the bottom end surface of the circular elastomeric member, a spring retainer portion on the other end thereof, and a threaded bore therethrough which threadedly engages the second threaded surface of the valve body stem; and a valve spring adapted to resiliently bias the valve body head and elastomeric valve seal into engagement with a portion of the interior of the valve body housing.

2. The improved valve assembly of claim 1 wherein the valve seat portion of the annular valve body housing comprises:

an annular cylindrical member having, on the exterior thereof, an arcuate cylindrical surface, a first cylindrical surface, a second cylindrical surface, and a third cylindrical surface and, on the interior thereof, a first cylindrical bore, an arcuate, frusto-conical sealing bore, a second cylindrical bore, and a threaded bore.

3. The improved valve assembly of claim 2 wherein the annular outer cylindrical member of the valve spring retainer portion further includes, on the exterior thereof, a threaded surface, a first cylindrical surface, a first frusto-conical surface, a second frusto-conical surface and a second cylindrical surface and, on the interior thereof, a first cylindrical bore, a first frusto-conical bore, a second frusto-conical bore and a second cylindrical bore.

4. The improved valve assembly of claim 3 wherein the valve body guide of the annular outer cylindrical member of the valve spring retainer comprises:

an annular cylindrical member having, on the exterior thereof, a first cylindrical surface and a second cylindrical surface and, on the interior thereof, a bore therethrough.

5. The improved valve assembly of claim 4 wherein valve seal retainer is retained on the second threaded portion of the valve body stem by means of a thread locking compound.

* * * * *